US010292553B1

(12) United States Patent
Ebrahimi Afrouzi et al.

(10) Patent No.: US 10,292,553 B1
(45) Date of Patent: May 21, 2019

(54) MOPPING EXTENSION FOR A ROBOTIC VACUUM

(71) Applicant: Bobsweep Inc., Toronto (CA)

(72) Inventors: Ali Ebrahimi Afrouzi, San Jose, CA (US); Soroush Mehrnia, Copenhagen (DK); Renee Bautista, San Francisco, CA (US)

(73) Assignee: Bobsweep Inc., Toronto (CA)

( * ) Notice: Subject to any disclaimer, the term of this patent is extended or adjusted under 35 U.S.C. 154(b) by 509 days.

(21) Appl. No.: 14/970,791

(22) Filed: Dec. 16, 2015

Related U.S. Application Data

(60) Provisional application No. 62/092,802, filed on Dec. 16, 2014, provisional application No. 62/155,733, filed on May 1, 2015.

(51) Int. Cl.
*A47L 5/00* (2006.01)
*A47L 7/00* (2006.01)
*A47L 9/00* (2006.01)

(52) U.S. Cl.
CPC ..... *A47L 7/009* (2013.01); *A47L 5/00* (2013.01); *A47L 7/0019* (2013.01); *A47L 9/00* (2013.01)

(58) Field of Classification Search
CPC ..... A47L 5/00; A47L 7/009; A47L 7/0019; A47L 9/00
See application file for complete search history.

(56) References Cited

U.S. PATENT DOCUMENTS 8,961,695 B2 * 2/2015 Romanov ..... A47L 11/4011 134/18
2005/0015913 A1 * 1/2005 Kim ..... A47L 5/30 15/319
2006/0185690 A1 * 8/2006 Song ..... A47L 11/34 134/21

* cited by examiner

*Primary Examiner* — Randall Chin
(74) *Attorney, Agent, or Firm* — Soody Tronson; STLG Law Firm

(57) ABSTRACT

A mopping extension attachable to a robotic vacuum. The mopping extension comprising, at minimum, a frame, a cloth, and a mechanism to secure the frame to the body of the robotic vacuum. The mopping extension may be installed in a dedicated compartment within the robotic vacuum body such that the cloth is dragged along the work surface as the robotic vacuum travels through the work area. In some embodiments, the mopping extension further comprises a means to automatically dampen the cloth to further improve cleaning efficiency. In some embodiments, the mopping extension further comprises means to move the mopping extension back and forth during operation to further improve cleaning efficiency. In some embodiments, the mopping extension further comprises a means to disengage and engage the mopping extension as the robotic vacuum is working.

8 Claims, 9 Drawing Sheets

MOPPING EXTENSION FOR A ROBOTIC VACUUM

CROSS-REFERENCE TO RELATED APPLICATIONS

This application claims the benefit of provisional patent application Ser. No. 62/092,802, filed Dec. 16, 2014 by the first named inventor and provisional patent application Ser. No. 62,155,733, filed May 1, 2015 by the first named inventor.

FIELD OF INVENTION

This invention relates to automated robotic devices. More particularly, this invention relates to robotic floor cleaning devices.

BACKGROUND OF INVENTION

The following is a tabulation of some prior art that presently appears relevant:

U.S. Patent Documents

| Pat. No. | Kind Code | Issue Date | Patentee |
|---|---|---|---|
| 8,739,355 | B2 | 2014 Jun. 3 | Irobot Corporation |
| 8,392,021 | B2 | 2013 Mar. 5 | Irobot Corporation |
| 6,741,054 | B2 | 2004 May 25 | Vision Robotics Corporation |
| 7,765,635 | B2 | 2010 Aug. 3 | LG Electronics Inc |
| 7,167,775 | B2 | 2007 Jan. 23 | F Robotics Acquisitions Ltd |
| 7,849,555 | B2 | 2010 Dec. 14 | Samsung Electronics Co Ltd |
| 7,555,363 | B2 | 2009 Jun. 30 | Neato Robotics Inc |

More efficient methods for cleaning are continuously sought after to meet consumer demands. This can be seen in robotic floor cleaning devices through software changes, such as improved navigation systems and hardware changes including stronger and more energy efficient motors, improved brush designs, improved debris storage containers, etc. Robotic floor cleaning devices also generally specialize in different functions, such as mopping, vacuuming, or polishing.

In prior art, separate robotic devices for vacuuming and mopping floors were introduced individually. Each of these apparatuses has only one function (mopping or vacuuming), which means that in order to thoroughly clean a work surface, a user would need to have a combination of devices and run them one after the other. This practice has a relatively high cost of ownership, high level of maintenance required, and long time to completion of a given workspace. A need exists for a method to provide vacuuming and mopping functions in a single robotic device.

SUMMARY OF INVENTION

It is a goal of the present invention to provide both mopping functionality and vacuuming functionality in a single robotic floor cleaning device.

It is a goal of the present invention to provide a comprehensive autonomous floor-cleaning method that is less expensive than currently available robotic systems.

It is a goal of the present invention to increase the cleaning effectiveness of a vacuuming robot.

It is a goal of the present invention to eliminate the need for multiple floor-cleaning robots to thoroughly clean an area.

It is a goal of the present invention to minimize the amount user maintenance required in using robotic systems to clean floors.

It is a goal of the present invention to provide a solution that minimizes the amount of time required to complete a comprehensive floor-cleaning job.

The present invention achieves the aforementioned objectives through a removable mopping extension that can be attached to an automated robotic vacuum to expand the vacuum's functionalities. With the extension, the device mops surfaces concurrently while vacuuming, increasing cleaning efficiency.

A mopping extension may be installed in a dedicated compartment in the chassis of an automated robotic vacuum. A cloth positioned on the mopping extension is dragged along the work surface as the automated robotic vacuum drives through the area. In some embodiments, nozzles direct fluid from a cleaning fluid reservoir to the mopping cloth. The dampened mopping cloth may further improve cleaning efficiency. In some embodiments, the mopping extension further comprises a means for moving back and forth in a horizontal plane parallel to the work surface during operation. In some embodiments, the mopping extension further comprises a means for moving up and down in a vertical plane perpendicular to the work surface to engage or disengage the mopping extension.

DETAILED DESCRIPTION OF THE INVENTION

The present invention proposes a mopping extension unit for an automated robotic vacuum to enable the device to simultaneously vacuum and mop work surfaces. The provisioned mopping extension would improve the cleaning effectiveness of a robotic vacuum and eliminates the need for a dedicated mopping robot to run after a dedicated vacuuming robot.

Figure 1:
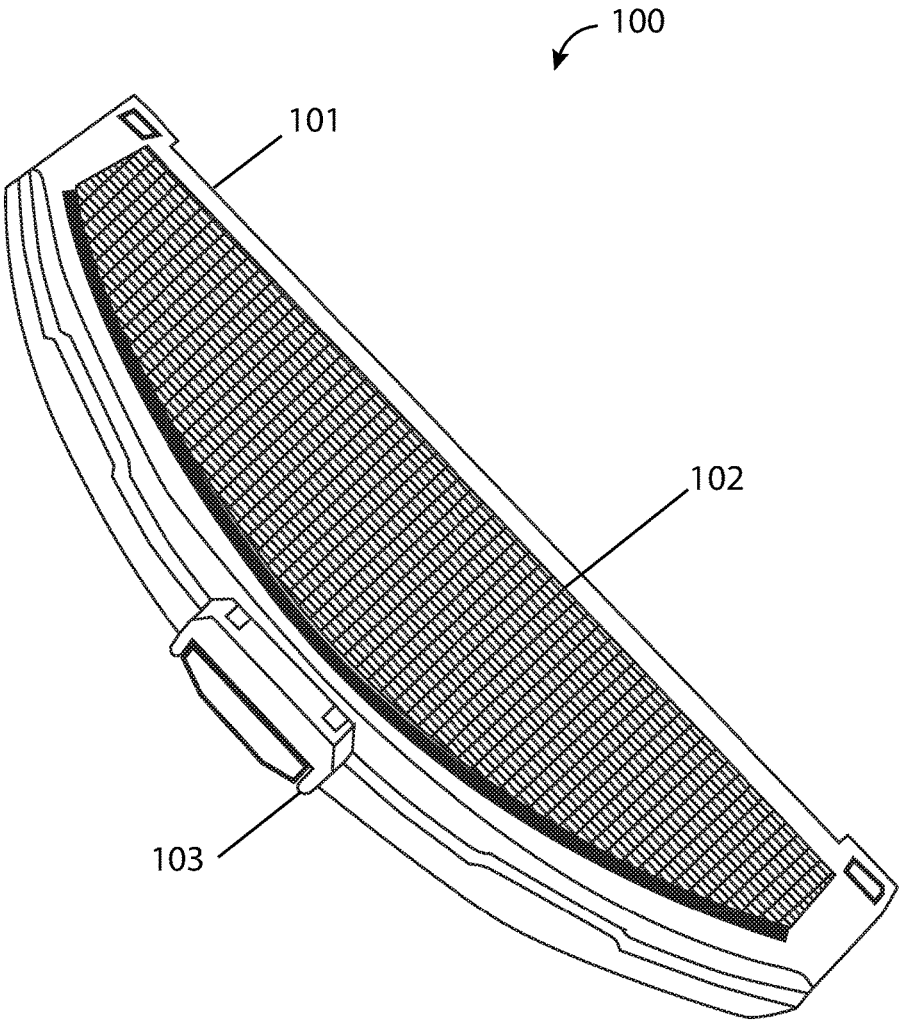
FIG. 1 illustrates an overhead view of the underside of a mopping extension embodying features of the present invention.

A detachable mopping extension that may be installed inside a dedicated compartment with the chassis of a robotic floor cleaning device is provisioned. Referring to FIG. 1, an overhead view of the underside of a detachable mopping extension 100 is illustrated. The mopping extension may be attached to the chassis of a robotic floor cleaning device (not shown). The mopping extension is comprised of a frame 101 that supports a removable mopping cloth 102 and a latch 103 to secure and release the mopping extension to and from the robotic floor cleaning device.

Figure 2:
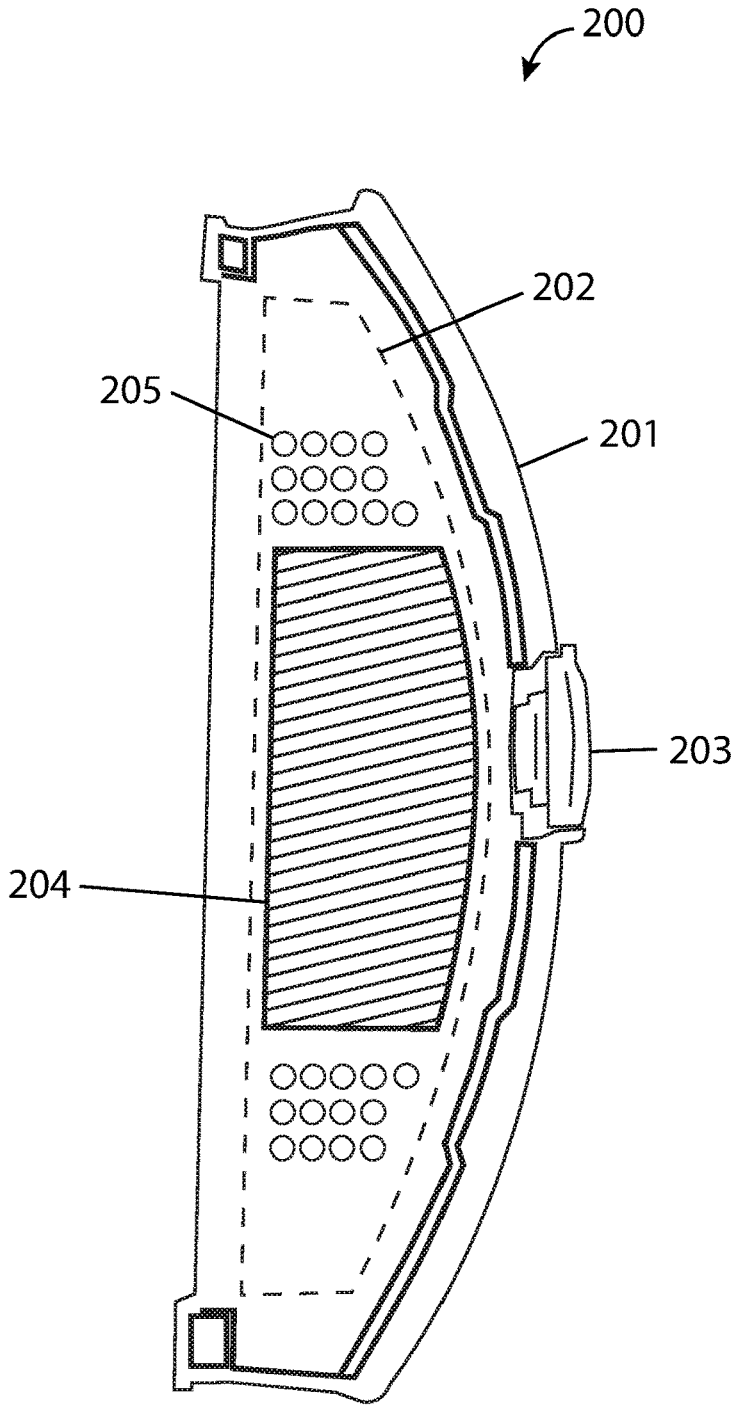
FIG. 2 illustrates an overhead view of a mopping extension showing the internal components embodying features of the present invention.

Referring to FIG. 2, the internal components of the mopping extension 200 are illustrated. The frame 201 supports the mop components. As mentioned previously, a latch 203 secures the mopping extension to the chassis of the robotic device and may be released to detach the mopping extension. In some embodiments, the mopping extension further comprises a refillable fluid reservoir 204 that stores cleaning fluid to be dispersed by nozzles 205 onto the mopping cloth 202. In some embodiments, the nozzles continuously deliver a constant amount of cleaning fluid to the mopping cloth. In some embodiments, the nozzles periodically deliver predetermined quantities of cleaning fluid to the cloth.

Figure 3:
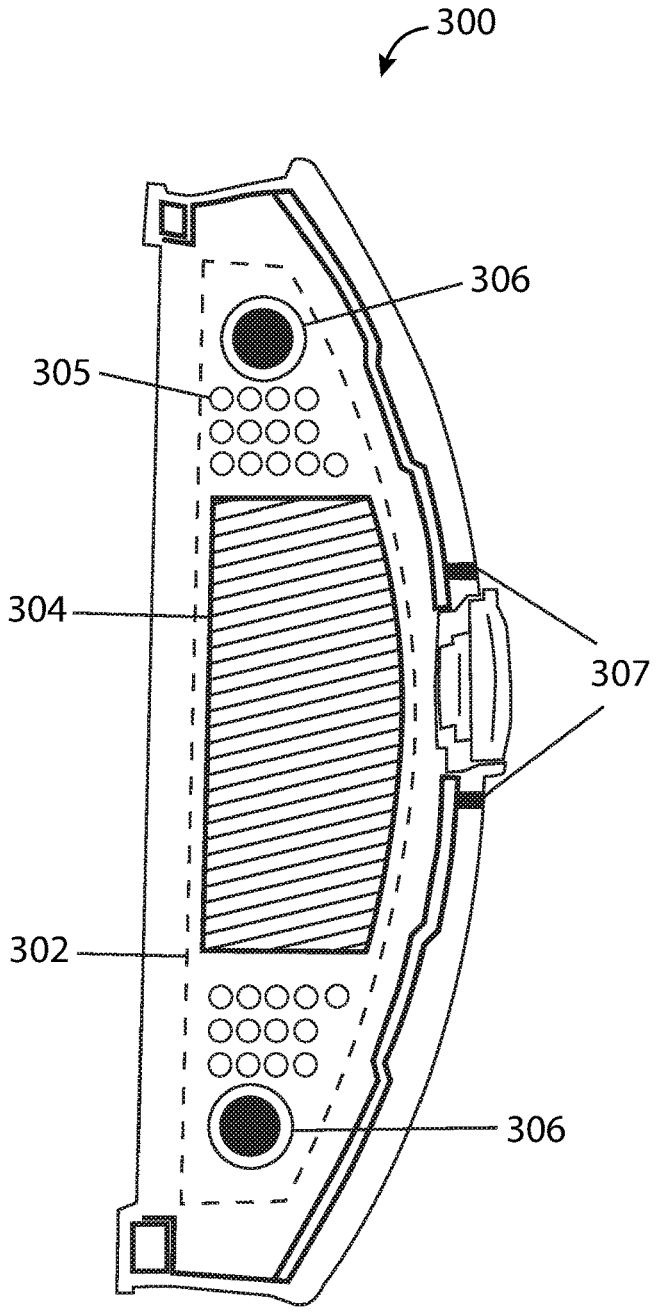
FIG. 3 illustrates an overhead view of a mopping extension with ultrasonic oscillators embodying features of the present invention.

Referring to FIG. 3, in some embodiments, the mopping extension 300 further comprises a set of ultrasonic oscillators 306 that vaporize fluid from the reservoir 304 before it is delivered through the nozzles 305 to the mopping cloth 302. Metal electrodes 307 provide power from a main battery (not shown) of the robotic device to the ultrasonic oscillators. In some embodiments, the ultrasonic oscillators vaporize fluid continuously at a low rate to continuously deliver vapor to the mopping cloth. In some embodiments, the ultrasonic oscillators turn on at predetermined intervals to deliver vapor periodically to the mopping cloth.

Figure 4A:
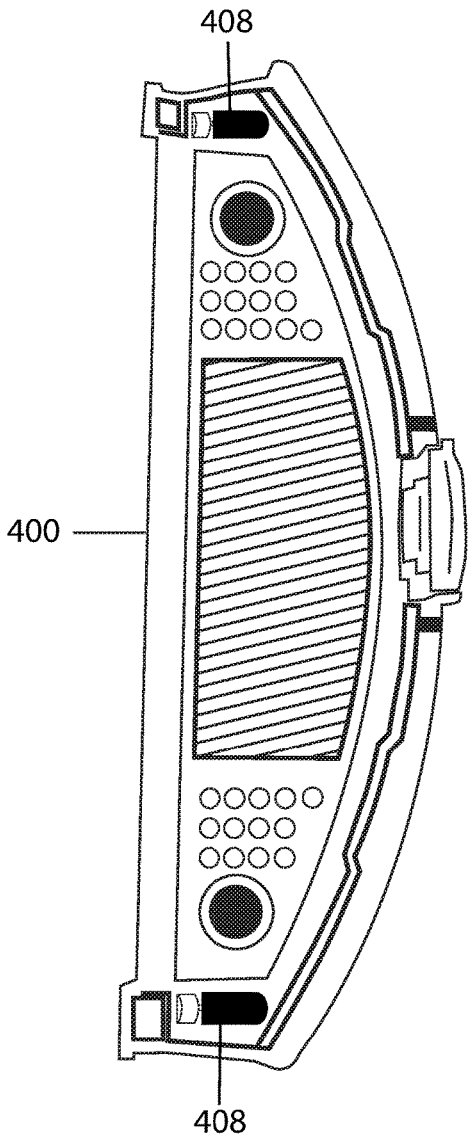
FIG. 4A illustrates an overhead view of a mopping extension with eccentric rotating mass vibration motors to provide vibrations to the mopping extension embodying features of the present invention.
Figure 4B:
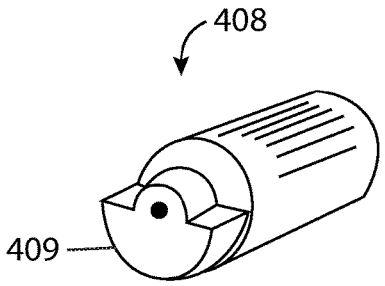
FIG. 4B illustrates a perspective view of an eccentric rotating mass vibration motor embodying features of the present invention.

In some embodiments, the mopping extension further comprises a means to vibrate the mopping extension during operation. Referring to FIG. 4A, a mopping extension 400 with eccentric rotating mass vibration motors 408 is illustrated. Referring to FIG. 4B, a close up perspective view of an eccentric rotating mass vibration motor 408 is illustrated. Eccentric rotating mass vibration motors rely on the rotation of an unbalanced counterweight 409 to provide vibrations to the mopping extension.

Figure 5:
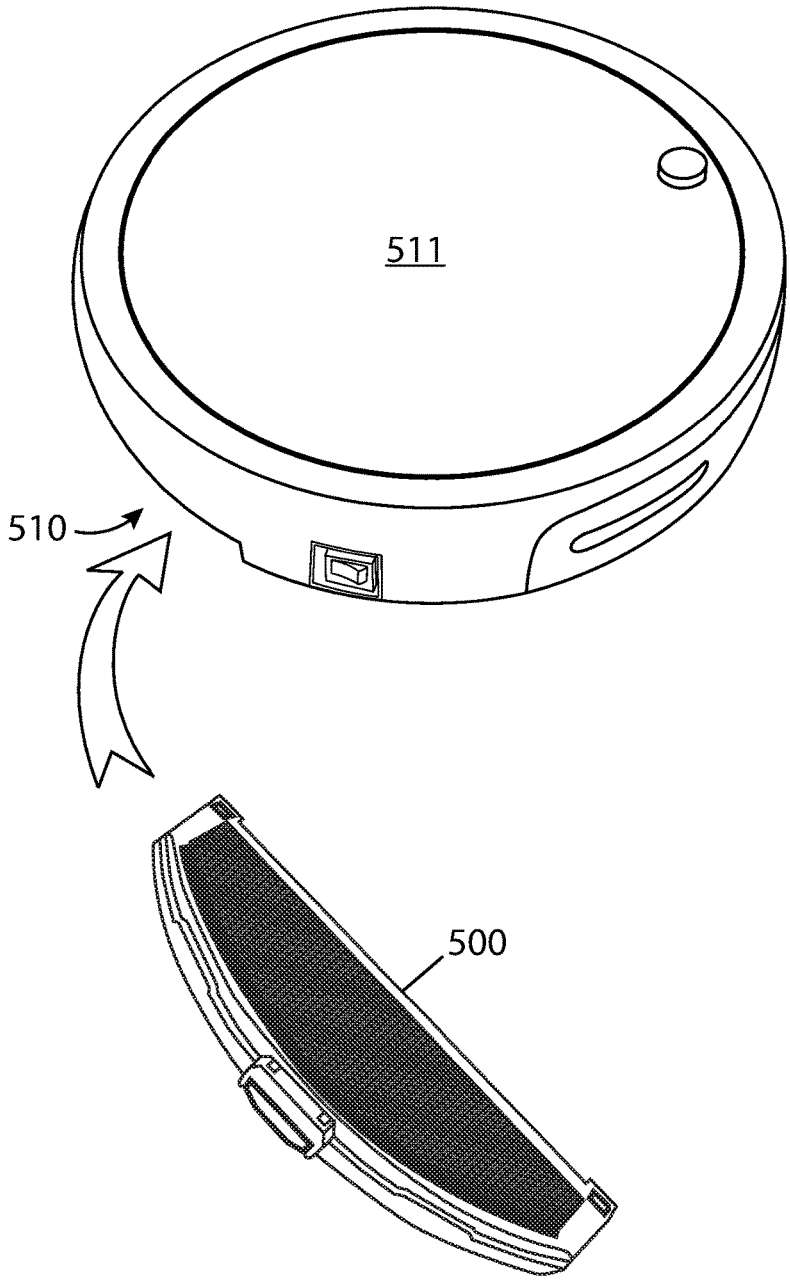
FIG. 5 illustrates the insertion of a mopping extension into a compartment in the chassis of a robotic vacuum embodying features of the present invention.

Referring to FIG. 5, a corresponding robotic vacuum to which the mopping extension may be attached is illustrated. The mopping extension 500 fits into a compartment 510 on the underside of the robotic vacuum 511 such that as the robotic vacuum drives, the mopping extension may be caused to make contact with the work surface.

Figure 6:
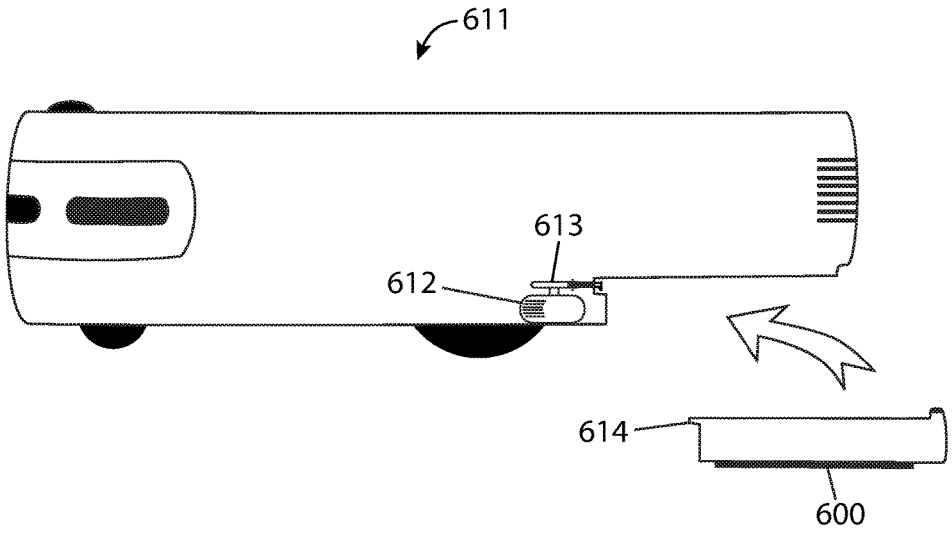
FIG. 6 illustrates a side view of a robotic vacuum with a motor to move a mopping extension to move back and forth during operation embodying features of the present invention.

In some embodiments, the mopping extension further comprises a means to move the mopping extension back and forth in a horizontal plane parallel to the work surface during operation. Referring to FIG. 6, a side elevation view of a robotic vacuum with a mechanism for moving the mopping extension back and forth is illustrated. An electric motor 612 positioned inside the chassis of the robotic vacuum 611 transfers movements to the mopping extension 600 through a rod 613 to tabs 614 on the mopping extension.

Figure 7A:
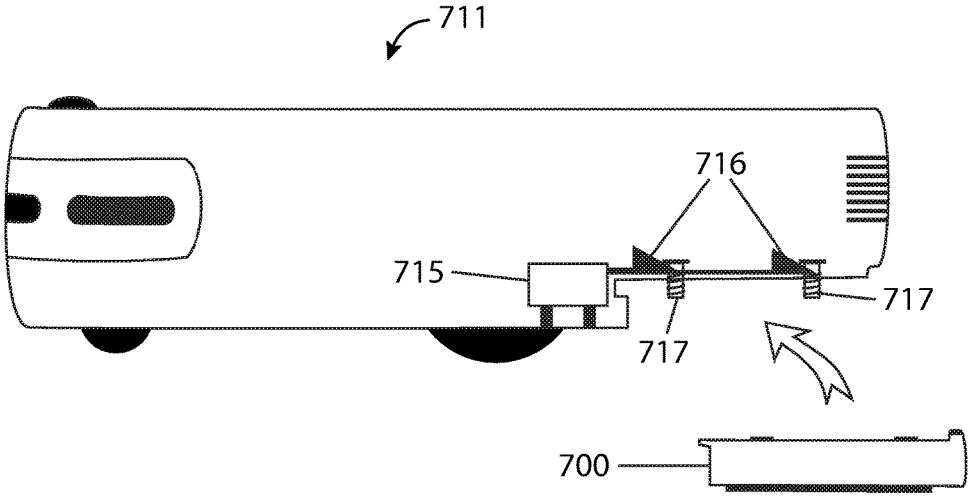
FIG. 7A illustrates a side view of a robotic vacuum with a mechanism for engaging and disengaging a mopping extension in an engaged position embodying features of the present invention.
Figure 7B:
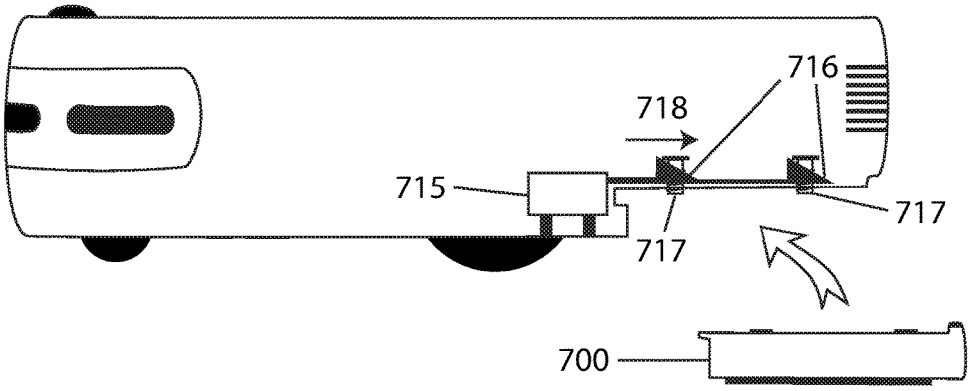
FIG. 7B illustrates a side view of a robotic vacuum with a mechanism for engaging and disengaging a mopping extension in a disengaged position embodying features of the present invention.

In some embodiments, the mopping extension further comprises a means to engage and disengage the mopping extension during operation by moving the mopping extension up and down in a vertical plane perpendicular to the work surface. In some embodiments, engagement and disengagement may be manually controlled by a user. In some embodiments, engagement and disengagement may be controlled automatically based on sensory input. Referring to FIG. 7A, a side view of a robotic vacuum 711 with a means for engaging and disengaging the mopping extension 700 is illustrated. (The mopping extension is shown not attached to the robotic vacuum in this example to more clearly show details; another example in which the mopping extension is attached will be provided later.) An electric servomotor 715 positioned within the chassis of the robotic vacuum pushes forward and pulls back wedges 716 that raise and lower springs 717 to which the mopping extension 700 may be attached. When the wedges are pulled back, as shown in FIG. 7A, the mopping extension, when attached, will be engaged. Referring to FIG. 7B, when the wedges 716 are pushed forward in a direction 718 by the electric servomotor 715, the springs 717 are raised and the mopping extension 700 is disengaged.

Figure 8A:
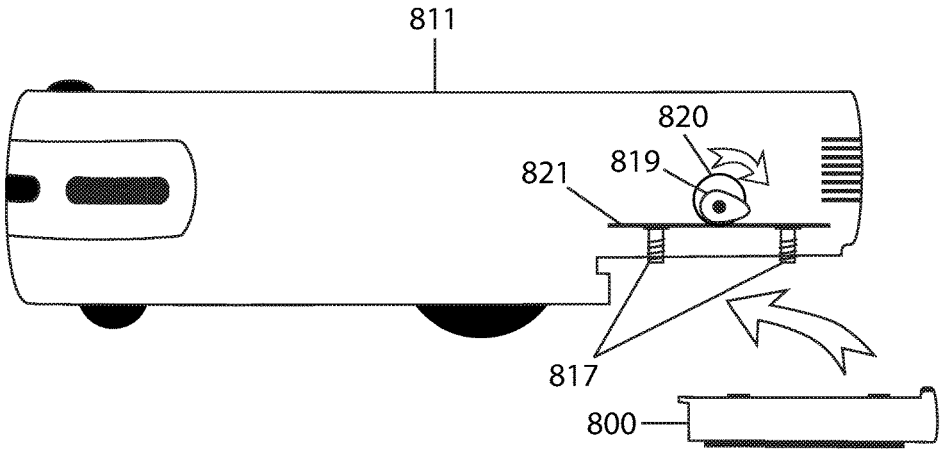
FIG. 8A illustrates a side view of a robotic vacuum with an alternative mechanism for engaging and disengaging a mopping extension in a disengaged position embodying features of the present invention.
Figure 8B:
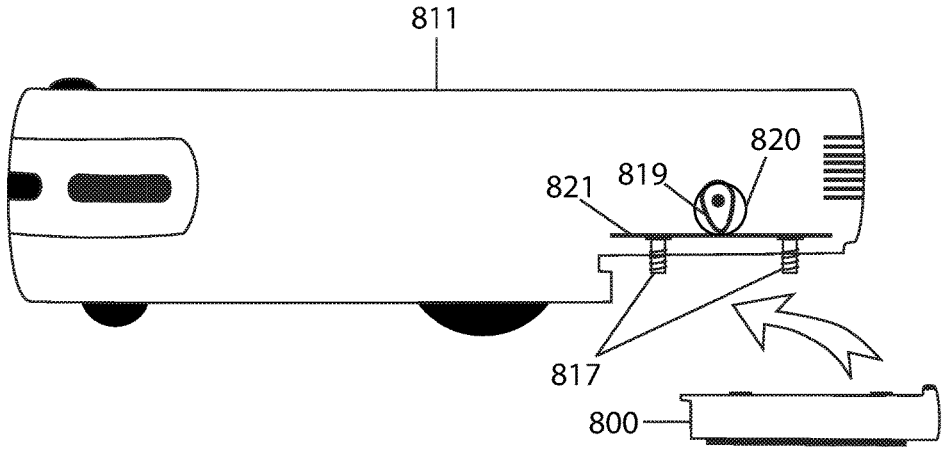
FIG. 8B illustrates a side view of a robotic vacuum with an alternative mechanism for engaging and disengaging a mopping extension in an engaged position embodying features of the present invention.

Referring to FIG. 8A and FIG. 8B, an alternate method for engaging and disengaging the mopping extension is illustrated. An oval wheel 819 positioned in the chassis of the robotic vacuum 811 is turned by an electric motor 820, which causes the wheel to push down a plate 821. When the wheel is not pushing the plate down, springs 817 are not pushed down and the mopping extension 800 is not engaged. Referring to FIG. 8B, when the wheel 819 is pushing down the plate 821, the springs 817 are pushed down which lowers the mopping extension 800, engaging it.

Figure 9A:
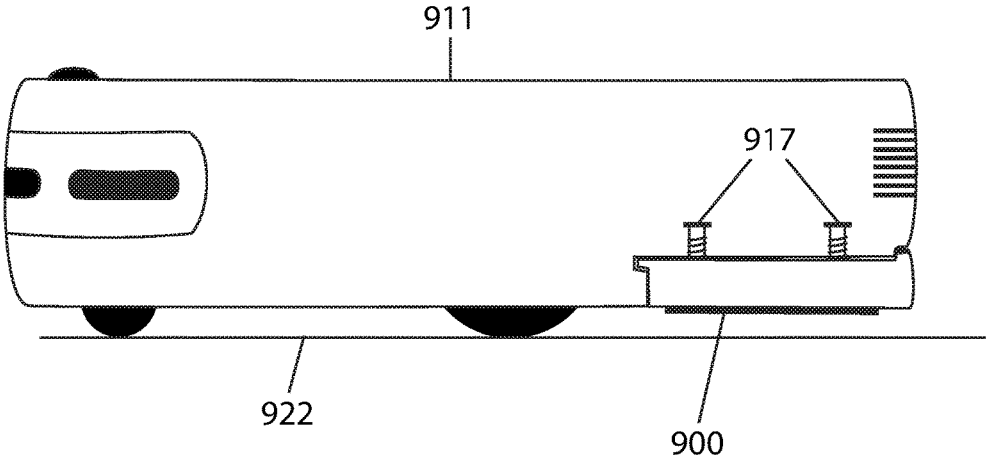
FIG. 9A illustrates a side view of a robotic vacuum with a mopping extension attached in a disengaged position embodying features of the present invention.
Figure 9B:
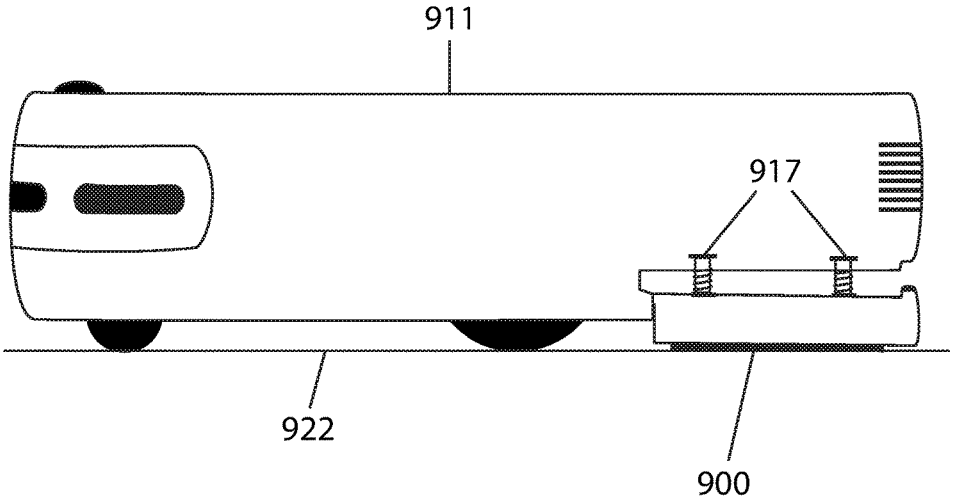
FIG. 9B illustrates a side view of a robotic vacuum with a mopping extension attached in an engaged position embodying features of the present invention.

Referring to FIGS. 9A and 9B, a robotic vacuum 911 with a mopping extension 900 attached is illustrated. In FIG. 9A, the springs 917 are not lowered and the mopping extension 900 is in a disengaged position, where the mopping extension cannot make contact with the work surface 922. Referring to FIG. 9B, the springs 917 are lowered and the mopping extension 900 is in an engaged position, such that the mopping extension makes contact with the work surface 922.

We claim:

1. An autonomous coverage robot comprising:

a chassis;

a drive system carried by the chassis configured to maneuver the robot over a work surface; right and left drive wheels;

a suctioning cleaning assembly mounted on the forward portion of the chassis;

one or more obstacle-detection sensors; and a detachable wiping cleaning assembly mounted on the rearward portion of the chassis comprising:

a frame to hold components corresponding with the detachable wiping cleaning assembly;

a cloth positioned on said frame for wiping the work surface;

a means for securing said frame to and releasing said frame from the chassis;

a fluid reservoir for storing a cleaning fluid; and nozzles to distribute said cleaning fluid to said cloth along a top surface of the cloth, wherein a bottom surface of the cloth contacts the work surface.

2. The autonomous coverage robot of claim 1, wherein said nozzles distribute a predetermined quantity of said cleaning fluid to said cloth at predetermined intervals.

3. The autonomous coverage robot of claim 1 wherein said nozzles continuously distribute a constant amount of said cleaning fluid to said cloth.

4. The autonomous coverage robot of claim 1, wherein the detachable wiping cleaning assembly further comprises:

one or more ultrasonic oscillators; and electrodes electrically coupled with said one or more ultrasonic oscillators to provide electricity thereto from a main battery of the robotic floor cleaning device; whereby said ultrasonic oscillators vaporize cleaning fluid from the fluid reservoir and then distribute the vapor through the nozzles to the cloth.

5. The autonomous coverage robot of claim 1 further comprising:

a means to vibrate the detachable wiping cleaning assembly during operation.

6. The autonomous coverage robot of claim 1 further comprising:

a means to move the detachable wiping cleaning assembly back and forth in a plane parallel to the work surface during operation.

7. The autonomous coverage robot of claim 1 further comprising:

a means to engage and disengage the detachable wiping cleaning assembly by moving the detachable wiping cleaning assembly up or down in a plane perpendicular to the work surface.

8. The autonomous coverage robot of claim 1, wherein the nozzles are disposed along and above each end of the cloth.

* * * * *